US011274394B2

(12) United States Patent
Gibbels et al.

(10) Patent No.: US 11,274,394 B2
(45) Date of Patent: Mar. 15, 2022

(54) COLORING PRODUCT, IN PARTICULAR FOR DYEING OR REFRESHING DYES IN TEXTILE MATERIALS

(71) Applicant: Brauns-Heitmann GmbH & Co. KG, Warburg (DE)

(72) Inventors: Uwe Gibbels, Warburg (DE); Aline Rosenfeldt, Hille (DE); Katja Fueser, Ruethen (DE)

(73) Assignee: Brauns-Heitmann GmbH & Co. KG, Warburg (DE)

( * ) Notice: Subject to any disclaimer, the term of this patent is extended or adjusted under 35 U.S.C. 154(b) by 123 days.

(21) Appl. No.: 15/776,997

(22) PCT Filed: Nov. 16, 2016

(86) PCT No.: PCT/EP2016/077836

§ 371 (c)(1),
(2) Date: May 17, 2018

(87) PCT Pub. No.: WO2017/085112

PCT Pub. Date: May 26, 2017

(65) Prior Publication Data

US 2018/0334774 A1 Nov. 22, 2018

(30) Foreign Application Priority Data

Nov. 18, 2015 (DE) ..... 102015119949.1

(51) Int. Cl.

| | |
|---|---|
| ***D06P 1/00*** | (2006.01) |
| ***C11D 3/40*** | (2006.01) |
| ***C11D 17/04*** | (2006.01) |
| ***D06P 5/00*** | (2006.01) |
| ***D06P 1/44*** | (2006.01) |
| ***D06P 5/24*** | (2006.01) |

(52) U.S. Cl.
CPC ..... *D06P 1/0016* (2013.01); *C11D 3/40* (2013.01); *C11D 17/041* (2013.01); *D06P 1/44* (2013.01); *D06P 5/008* (2013.01)

(58) Field of Classification Search
CPC ..... D06P 1/0016; D06P 1/44; D06P 5/008; C11D 3/40; C11D 17/041
See application file for complete search history.

(56) References Cited

U.S. PATENT DOCUMENTS

| | | | | | |
|---|---|---|---|---|---|
| 3,995,992 | A * | 12/1976 | Defago | ..... | B41M 5/385 8/470 |
| 4,167,392 | A | 9/1979 | Defago | | |
| 2006/0021163 | A1 * | 2/2006 | Chervin | ..... | B41M 5/035 8/471 |
| 2009/0151083 | A1 | 6/2009 | Orlandi et al. | | |

FOREIGN PATENT DOCUMENTS

| | | | | | |
|---|---|---|---|---|---|
| CH | 567147 | B5 | | 9/1975 | |
| DE | 2558931 | A1 | | 7/1976 | |
| DE | 2733960 | | * | 2/1978 | |
| DE | 2733960 | A1 | | 2/1978 | |
| DE | 10360842 | | * | 12/2004 | |
| DE | 10360842 | A1 | | 12/2004 | |
| DE | 102014016675 | A1 | | 5/2016 | |
| GB | 1566280 | A | | 4/1980 | |
| JP | 02003277655 | | * | 10/2003 | ..... C09D 11/00 |
| WO | 2007083335 | A2 | | 7/2007 | |
| WO | 2009146069 | A2 | | 12/2009 | |
| WO | 2012107405 | A1 | | 8/2012 | |

OTHER PUBLICATIONS

Derwent 1977-85507Y, 1986.*
Polyvinyl alcohol compound summary , pubchem, Dec. 20, 2019.*
Physical properties of hydroxyethyl cellulose, Dec. 12, 2013 https://celluloseether.com/physical-properties-of-hydroxyethyl-cellulose/.*

* cited by examiner

*Primary Examiner* — Amina S Khan
(74) *Attorney, Agent, or Firm* — Dinsmore & Shohl LLP

(57) ABSTRACT

A coloring product for dyeing or refreshing dyes in textile materials is disclosed. The coloring product includes a flat carrier material, at least one coating applied to the carrier material, and at least one dye in the coating. The at least one dye is present in a quantity ranging from 45% by weight 98% by weight in relation to the overall quantity of the coating. The flat carrier material is a nonwoven. The coloring product may be included in a washing machine that has textile materials in an aqueous solution at a temperature of at least 20° C. over a period of at least 10 minutes.

15 Claims, No Drawings

COLORING PRODUCT, IN PARTICULAR FOR DYEING OR REFRESHING DYES IN TEXTILE MATERIALS

CROSS-REFERENCE TO RELATED APPLICATIONS

This application is the U.S. national stage of PCT/EP2016/077836 filed Nov. 16, 2016, which claims priority of German Patent Application No. DE102015119949 filed on Nov. 18, 2015, which is incorporated herein by reference in its entirety.

FIELD OF THE INVENTION

The present invention relates to a coloring product, in particular for dyeing or refreshing dyes in textile materials, preferably in a washing machine, comprising a flat carrier material, and a coating composition for a flat carrier material, a method for dyeing or refreshing dyes in textile materials, and the use of the product according to the invention.

BACKGROUND OF THE INVENTION

Textile products in the form of sheets are known from the prior art that prevent a greying of white or light laundry, i.e. textiles. Such textile products contain cationic resins or substances that have a similar effect, which prevent a greying of laundry when they interact with other substances, even after numerous launderings.

This problem is reversed with dark, in particular black, laundry. These may also become grey after numerous launderings. So-called black detergents are known for this, which help somewhat in preventing the greying of dark, in particular black, laundry. Such black detergents are added to laundry in the same manner as normal detergents, in particular in washing machines. However, the effectiveness of known black detergents on the market is not such that a greying of black laundry in particular can be arrested permanently.

There is therefore a desire to arrest a greying of darker, in particular black, laundry or to at least delay the greying over the course of numerous launderings.

The object of the present invention is therefore to produce a product that prevents the greying of darker, in particular black, laundry, even after numerous launderings.

This problem is solved according to the invention by a coloring product, in particular for dyeing or refreshing colors in textile materials, preferably in a washing machine, comprising a flat carrier material, at least one coating applied to the carrier material, and at least one dye comprised in the coating. The coloring product according to the invention can be used for dyeing textile materials, but also for refreshing dyes in textile materials. Textile materials as set forth in the present invention are those, in particular, that are made of cotton, organic fibers or polyamides, or mixtures thereof. A refreshing of dyes as set forth in the present invention then takes place when a greying of darker, in particular black, laundry is to be prevented, i.e. the greying over the course of numerous launderings of the textile material in question is slowed or even arrested, or greyed laundry regains its color. According to the purpose of the present invention, the coloring product is contains no color traps, e.g. polyvinylpyrrolidones (PVP) that have color trapping effects or properties.

Laundering tests with the product according to the invention provided with the dark or black dye, or dye mixtures, have shown that even after twenty launderings of dark or black textiles, the greying thereof is significantly reduced, or even arrested, while in a comparison study, after twenty launderings of black textiles without adding the coloring product, an obvious greying could be observed.

SUMMARY OF THE INVENTION

In one aspect, there is disclosed a coloring product for dyeing or refreshing dyes in textile materials. The coloring product includes a flat carrier material, at least one coating applied to the carrier material, and at least one dye in the coating. The at least one dye is present in a quantity ranging from 45% by weight 98% by weight in relation to the overall quantity of the coating. The flat carrier material is a non-woven.

In another aspect, there is disclosed a method for dyeing or refreshing dyes in textile materials. The method includes adding a coloring product that includes a flat carrier material, at least one coating applied to the carrier material, and at least one dye in the coating in a washing machine that has textile materials in an aqueous solution at a temperature of at least 20° C. over a period of at least 10 minutes.

DETAILED DESCRIPTION OF THE PREFERRED EMBODIMENTS

The product according to the invention is composed substantially of a flat carrier material and a coating applied thereto. There is preferably at least one dye in the coating. The flat carrier material can also be referred to as a dye sheet. The size of the flat carrier material can be selected arbitrarily, and the amount of coating, including the at least one dye comprised therein, can be selected on the basis thereof. By way of example, the flat carrier material can be 10×10 cm, or 13.5×19.5 cm. The amount of coating on such a sheet can range from approx. 400 mg to approx. 7,000 mg, preferably ranging from approx. 500 mg to approx. 5,000 mg. The amount of the at least one dye in the flat carrier material ranges from approx. 100 mg, preferably approx. 150 mg, to approx. 1,500 mg, preferably in a range of approx. 200 mg to approx. 1,000 mg. It is particularly preferred with the product according to the invention, that this product advantageously appears to be very light, or white, instead of dark, depending on the flat carrier material that is used, when it has been removed, e.g. from the washing machine, after use, i.e. the dyeing of the actual flat carrier material is clearly visible. As a result, the user has receives direct feedback regarding the effects of the product according to the invention. This is based on the fact that the coating applied to the flat carrier material dissolves, at least in part, and releases at least some of the dye.

In a preferred embodiment, the coating comprises at least one binding agent for the at least one dye, such that the at least one dye can be released in an aqueous solution at temperatures equal to or above approx. 20° C. The release of the at least one dye preferably takes place in that the coating is at least partially released from the flat carrier material in a laundering, such that the binding agent is also at least partially released from the flat carrier material. Because of the release of the at least one dye, a white, or nearly white used product is obtained after a laundering, e.g. when a white flat carrier material is used, from which the user of the coloring product can derive its function and effect directly.

The at least one dye is preferably released in an aqueous solution at temperatures ranging from approx. 25° C. to approx. 95° C., more preferably at temperatures ranging from approx. 30° C. to approx. 65° C. The aqueous solution particularly preferably exhibits a pH in a range of approx. 8 to approx. 14, more preferably in a range of approx. 9.5 to approx. 13. The aqueous solution particularly preferably contains a detergent, preferably a powdered detergent. The coating is particularly preferably formed such that when the coloring product according to the invention is used by the user, when the user holds the product and places it in a washing machine for laundering, the coating is not released from the flat carrier material, and in particular, the at least one dye is not transferred to the hand of the user. The coating on the at least one flat carrier material can be applied in one or more layers, e.g. in two or three layers, and be applied to the flat material with a spreading blade or a dyeing machine. With multiple coatings, the amount of dye on the flat carrier material can be increased, such that the amount thereof on the material can be easily increased in a production process. The coating can also be applied to one or both sides of the flat carrier material. It is preferably applied to only one side of the flat carrier material, however. The coating can also be applied in the form of a design, e.g. a company logo or the like.

The at least one binding agent is preferably selected from a group comprising organic and/or synthetic resins, rubber, gum arabic, guar gum, gelatins, dextrins, agar, alginic acid, alginates, carrageen, albumen, gallant, carob gum, pectin, modified cellulose, starches, modified starches, and/or xanthan.

The at least one binding agent is particularly preferably selected from the group of synthetic resins comprising polyester, polyvinyl acetate, polyacrylate, polyglycols, polyvinyl alcohols, and/or polyvinylpyrrolidone (PVP), and/or mixtures of the specified polymers, that have no color trapping effects or properties. The synthetic resins are particularly preferably non-ionic or anionic-active. Gum arabic is also a particularly suitable binding agent. It is particularly preferred that at least one binding agent is selected from a group comprising polyester and/or polyvinyl acetate, preferably in an aqueous dispersion, and also preferably non-ionic. The binding agent is particularly preferably formed by the mixture of a polyvinyl acetate with a polyester.

The at least one binding agent is preferably present in the coating in a range of approx. 1% by weight to approx. 50% by weight in relation to the overall quantity of the coating. In particular when the at least one binding agent is selected from the group of organic products, such as gum arabic, gelatins, gellan gum, etc., it is present in the coating in a range of approx. 1.5% by weight to approx. 10% by weight, more preferably in a range of approx. 2.2% by weight to approx. 6% by weight in relation to the overall quantity of the coating. In particular when the at least one binding agent is selected from a group of organic and/or synthetic resin, selected in particular from the synthetic resins specified as preferred above, or in mixtures thereof, the at least one binding agent is present in the coating in a range of approx. 2.5%, preferably approx. 4% by weight, to approx. 49% by weight, more preferably in a range of approx. 10% by weight to approx. 45% by weight, in relation to the overall quantity of the coating. If there are at least two binding agents in the coating, then one of these is present in the coating in a range of approx. 2% by weight to approx. 25% by weight, more preferably in a range of up to approx. 22% by weight, to the overall quantity of the coating. If a polyester and a polyvinyl acetate, as described above, are used, the polyester is preferably present in the coating in a range of approx. 10% by weight, preferably approx. 15% by weight, to approx. 40% by weight, preferably in a range of approx. 12% by weight, preferably approx. 20% by weight to approx. 35% by weight, in relation to the overall quantity of the coating, and the polyvinyl acetate is present in the mixture in a range of approx. 6% by weight to approx. 20% by weight, in relation to the overall quantity of the coating.

The coating preferably comprises at least two binding agents, in particular such as those described above. A first binding agent particularly preferably has a pH in a range of approx. 3.5 to approx. 5.5, and a second binding agent has a pH in a range of approx. 5.6 to approx. 9. The at least one binding agent is particularly preferably non-ionic.

As a rule, numerous dyes can be used in the coloring product according to the invention. Dyes are particularly preferably used that are selected from the group of azo dyes that do not react to fibers, or reactive dyes. Azo dyes have one or more azo bonds in the form of a chromophore. The at least one dye of the coloring product according to the invention is particularly preferably black or blue. Examples of black dyes that can particularly preferably be used are the dyes Sirius Schwarz OBV and Sirius Schwarz VSF (in particular Sirius Schwarz OB-V01 and Sirius Schwarz VSF h/c, produced by Dystar Colours Distribution GmbH, Raunheim, Germany). The two black dies specified above are azo dyes. But other dyes, in particular dark blue, dark grey, or black azo dyes can also be preferably used in the coloring product according to the invention. Reactive dyes that can be used are, e.g., Reactive Black 5 as a black dye or Remazol Marine GG as a blue dye. In order to prevent a greying of dark colored textiles, in particular dark blue, dark grey and/or black textiles, or refresh their colors, in particular dark blue, dark grey and/or black azo dyes are used.

The at least one dye is particularly preferably present therein in a quantity ranging from approx. 28% by weight, preferably approx. 30% by weight, and more preferably approx. 45% by weight, to approx. 98% by weight in relation to the overall quantity of the coating. If an organic binding agent, such as gum arabic, gelatin, gellan gum or the like, is used as the binding agent, but not an organic and/or synthetic resin, the amount of the at least one dye that is used is advantageously present in a range of approx. 70% by weigh to approx. 98% by weight, more preferably in a range of approx. 78% by weight to approx. 97.8% by weight, in each case in relation to the overall quantity of the coating. If the at least one binding agent is selected from a group comprising organic and/or synthetic resins, preferably synthetic resins, in particular those described further above as particularly preferred, and in combinations with one another, the at least one dye is present therein in a quantity ranging from approx. 30% by weight, preferably 48% by weight, to approx. 80% by weight, more preferably in a quantity ranging from approx. 52% by weight to approx. 70% by weight, in each case in relation to the overall quantity of the coating.

The at least one dye particularly preferably has a pH in a range of approx. 7 to approx. 11, more preferably in a range of approx. 8.35 to approx. 10. Particularly preferably, there are at least two dyes provided in the coating. Particularly preferably, the at least two dyes are selected from a group comprising dark blue, dark grey, and/or black dyes. Particularly preferably, there are exactly two dyes in the coating. In a particularly preferred embodiment, the coating has one dark blue or dark grey dye and one black dye, or two black dyes. A mixture of two black dyes is particularly preferred, and more particularly preferred is a mixture of the two black dyes Sirius Schwarz OBV (in particular OB-V01) and Sirius Schwarz VSF (in particular VSF h/c). If at least two dyes are provided in the coating, these are each present therein in a quantity ranging from approx. 15% by weight to approx. 49% by weight, preferably ranging from approx. 25% by weight to approx. 49% by weigh, in each case in relation to the overall quantity of the coating. If exactly two dyes are present in the coating, they can particularly preferably be present therein in identical quantities. If two black dyes are present in the coating of the coloring product according to the invention, preferably the two black dyes Sirius Schwarz OBV (in particular OB-V01) and Sirius Schwarz VSF (in particular VSF h/c), the one black dye Sirius Schwarz OBV (in particular OB-V01) is preferably present in a quantity ranging from approx. 25% by weight to approx. 38% by weight, and the other black dye, Sirius Schwarz VSF (in particular VSF h/c) is preferably present in a quantity ranging from approx. 20% by weight to approx. 30% by weight, in each case in relation to the overall quantity of the coating. Different quantities of at least two dyes are then present in particular when the binding agent is selected from a group comprising organic and/or synthetic resins, in particular the preferred resins, or mixtures thereof, specified above. If at least one blue, preferably exactly one blue dye is provided, it is preferably comprised in the coating in a quantity ranging from approx. 28% by weight to approx. 50% by weight, preferably in a range of approx. 30% by weight to approx. 45% by weight, in each case in relation to the overall quantity of the coating.

With the parameters defined above, the coating, and in particular the dyes comprised in the coating, will not flake off of the flat carrier material. In particular if the flat carrier material is folded or otherwise deformed, a crumbling of the coating on the flat carrier material is safely prevented as a result of the preferred specified parameters with regard to the dye, as well as the binding agent. The binding agent, in particular in the form of the preferred or particularly preferred binding agents above, advantageously serves to prevent a crumbling of the dye on the flat product. As a result, a transferring of the dye to the hands of the user is also prevented, and a sufficiently secure adhesion of the dye to the flat carrier material is also obtained.

The ratio of the quantity of the at least one binding agent to the at least one dye in the coating on the coloring product according to the invention ranges from approx. 1:1 to approx. 1:4, preferably ranging from approx. 1:1.25 to approx. 1:3.5.

The coloring product according to the invention can furthermore advantageously comprise at least one thickening agent in the coating. The at least one thickening agent serves advantageously to adjust the viscosity depending on the use of the binding agent or dye that is used. The at least one thickening agent is particularly preferably selected from a group comprising polyacrylate, in particular in an aqueous dispersion. The polyacrylate is preferably anion-active. The polyacrylate is also preferably not active as a color trap. The pH of the at least one thickening agent advantageously lies in a range of approx. 1.5 to approx. 6, preferably in a range of approx. 1.8 to approx. 4.5. The at least one thickening agent is preferably used in a range of approx. 1% by weight to approx. 3.5% by weight, preferably to approx. 2% by weight, in relation to the overall quantity of the coating.

In a further preferred embodiment of the invention, the coloring product comprises urea in a quantity ranging from approx. 2% by weight to approx. 30% by weight, more preferably in a range of approx. 4% by weight to approx. 27% by weight, in relation to the overall quantity of the coating on the coloring product. The urea serves to keep the viscosity substantially constant when the coating is applied to a flat carrier material, and thus in particular to also prevent a subsequent thickening of the coating after it is applied to the sheet.

The at least one flat carrier material is particularly preferably a nonwoven fabric. The flat carrier material is preferably white or light colored.

The flat carrier material is preferably made of fibers that do not become dyed directly by dyes, particularly preferably by azo dyes, in particular the dark blue, dark grey and/or black dyes, as specified further above. The at least one flat carrier material is particularly preferably such a one that releases dyes applied thereto well, i.e. from which these dyes are released readily or very readily, preferably at least in part with the coating.

Synthetic fibers are preferably primarily used to form this nonwoven, preferably polymer fibers and/or combinations of organic and synthetic fibers. The flat carrier material is preferably flexible, can be easily grasped and easily handled by the user. In order to produce a preferred nonwoven as set forth in the present invention with a polymer base, any strand-forming polymer can be used that has properties when melted or dissolved that fulfill the conditions for being spun. By way of example, polymers from the group of polyolefins in the form of homopolymers or blends, polyamides, polyester, decomposable polymers, e.g. having a polylactic acid base or starch base, are suitable for producing this nonwoven. Nonwovens that have a polyolefin base have proven to be particularly advantageous for the flat carrier material, wherein the flat carrier material is particularly preferably a viscose/polyester nonwoven. The flat carrier material and thus the preferred nonwoven can have a single or multi-layered structure. Single-layer materials can be made of fibers and/or filaments, made of staple or continuous strands, which are generated, for example, according to a spunbond process or melt-blown process or carding process or a wet-spinning process, in order to produce the flat carrier material. Multi-layer nonwovens can be formed with a polymer base, for example, wherein intermediate layers can also be formed, which are substantially or entirely formed from other fibers than those in the outer layers, and can also be formed, for example, from organic or degradable fibers. Alternatively to the preferred nonwovens as set forth in the present invention, porous film layers can also be used as the flat carrier material. Typical weights per unit of surface area for the nonwoven or porous film layers for forming a flat carrier material lie in a range of approx. 10 $g/m^2$ to approx. 200 $g/m^2$, preferably in a range of approx. 25 $g/m^2$ to approx. 100 $g/m^2$. Multilayer formations can be generated in separate processing procedures or in a single processing procedure, e.g., sequentially. The fiber or filament diameters of a nonwoven according to the invention that is preferably used can lie in a range of less than approx. 0.001 mm to more than approx. 0.2 mm, wherein the cross section of the fiber can be round, non-round, e.g. elliptical, rectangular, polygonal, or multilobal, preferably trilobal. The fibers and/or filaments can be formed as monofilaments or multi-component filaments. The bonding of the fibers in the nonwoven can take place through thermobonding, adhesive bonding, e.g. by means of hot glue, or needling, water jet peening, or the like.

The design of the fiber cross section, the thickness, and the layered structure of the flat carrier material, as well as the combination of organic and/or synthetic fibers, all have an effect on increasing the releasing of color by the at least one dye, or the at least one coating in the product according to the invention. The flat material can also be produced from different materials, and can also exhibit a lamination with a foil or film on one side, for example, that cannot be permeated by a coloring agent, such that the risk of staining is reduced. If a viscose polyester nonwoven is used, it can be made of equal parts viscose and polyester. It may also be the case that one of the two components is present in a greater quantity than the other. Accordingly, in the particularly preferred viscose/polyester unwoven, a portion of viscose can be present in a range of approx. 40% by weight to approx. 50% by weight, and the portion of polyester can range from approx. 40% by weight to approx. 60% by weight, in each case in relation to the overall quantity of the nonwoven. The thickness of the flat carrier material preferably lies in a range of approx. 0.35 mm to approx. 0.8 mm. Alternative nonwovens can be composed, for example, of polyethylene styrol or polypropylene, or mixtures thereof.

The flat carrier material particularly preferably cannot be stained by the at least one dye. As a result, the flat carrier material is lighter or whiter after it has been removed from the washing machine following a laundering, such that the user immediately gets an impression of the effect that the product according to the invention has.

The sheet according to the invention preferably has a coating, which has approx. 1% by weight to approx. 3.5% by weight, preferably approx. 2% by weight to approx. 3% by weight gum arabic as a binding agent, and approx. 96% by weight to approx. 98.5% by weight of at least one dye, in each case in relation to the overall quantity of the coating. A mixture of two dyes, specifically the aforementioned dyes Sirius Schwarz OBV (or OB-V01) and Sirius Schwarz VSF (in particular VSF h/c), preferably in equal quantities, is particularly preferably used. Another preferred composition for the coating on the flat carrier material of the product according to the invention has approx. 18% by weight, preferably approx. 35% by weight, to approx. 46% by weight of at least one binding agent, preferably a quantity ranging from approx. 38% by weight to approx. 44% by weight, in each case in relation to the overall quantity of the coating. The at least one binding agent is preferably selected from two binding agents thereby, specifically a polyester and a polyvinyl acetate, as described above. A polyester serving as a binding agent is preferably present in the coating in a quantity ranging from approx. 12% by weight, preferably approx. 15% by weight, to approx. 35% by weight, in relation to the overall quantity of the coating. A polyvinyl acetate is advantageously present in the coating in a quantity ranging from approx. 5% by weight to approx. 15% by weight, in relation to the overall quantity of the coating. There is advantageously at least one dye in this mixture, in particular a black dye, in a quantity ranging from approx. 30% by weight, preferably approx. 50% by weight, to approx. 65% by weight, more preferably in a quantity ranging from approx. 55% by weight to approx. 64% by weight, in relation to the overall quantity of the coating. The at least one dye is particularly preferably formed from two dyes, more preferably from exactly two dyes, preferably the two aforementioned Sirius Schwarz dyes. Moreover, such a composition can also comprise a thickening agent, preferably in a quantity ranging from approx. 5% by weight to approx. 30% by weight, preferably to approx. 15% by weight, in relation to the overall quantity of the coating.

A further preferred composition of the coating on the flat carrier material comprises approx. 20% by weight to approx. 33% by weight of at least on binding agent in relation to the overall quantity of the coating. The at least one binding agent is formed preferably by a polyester and a polyvinyl acetate. The polyester advantageously comprises a quantity ranging from approx. 10% by weight, preferably approx. 12% by weight, to approx. 30% by weight in relation to the overall quantity of the coating, and the polyvinyl acetate preferably comprises a quantity ranging from approx. 0.4% by weight, preferably approx. 3% by weight, to approx. 10% by weight, in relation to the overall quantity of the coating. Such a composition of the coating advantageously also comprises at least one dye in a quantity ranging from approx. 28% by weight, preferably approx. 45% by weight, to approx. 80% by weight, further preferably in a quantity ranging from approx. 60% by weight to approx. 78% by weight, in each case in relation to the overall quantity of the coating. The at least one black dye is advantageously formed by two dyes thereby, more preferably by two dark blue, dark grey and/or black dyes, in particular the two preferred black dyes specified above. A thickening agent can also be present in the quantities described above.

The aforementioned compositions can be applied, for example with an air knife, on the flat carrier material, preferably a viscose polyester nonwoven, as described above, in that corresponding aqueous coating compositions are applied thereto, and subsequently dried at, e.g., 100° C.

The present invention also relates to a coating composition, preferably an aqueous composition, for a flat carrier material for dyeing or refreshing dyes in textile materials, comprising at least one dye and at least one binding agent for the at least one dye, such that the at least one dye can be released into an aqueous solution starting at a temperature of at least 20° C., preferably at a temperature ranging from approx. 25° C. to approx. 95° C., more preferably at a temperature ranging from approx. 30° C. to approx. 65° C. In this regard, that already explained in conjunction with the product according to the invention applies. The coating composition differs from the coating of the product according to the invention in that it also contains at least one solvent. The solvent is preferably water, but can also be ethanol, acetone or a similar solvent, or mixtures thereof.

The coating composition particularly preferably comprises at least one dye in a quantity ranging from approx. 4% by weight to approx. 50% by weight, preferably in a quantity ranging from approx. 6% by weight to approx. 35% by weight, more preferably in a range of approx. 12% by weight to approx. 32% by weight, in each case in relation to the overall quantity of the coating composition. The at least one binding agent is preferably comprised in the coating composition in a quantity ranging from approx. 0.2% by weight to approx. 28% by weight, more preferably to approx. 20% by weight, and even more preferably in a quantity ranging from approx. 0.4% by weight to approx. 15% by weight, in each case in relation to the overall quantity of the coating composition. If gum arabic is used in the coating composition according to the invention, then it is comprised therein advantageously in a quantity ranging from approx. 0.2% by weight to approx. 2% by weight in relation to the overall quantity of the coating composition. If the at least one binding agent is selected from the group of organic and/or synthetic resins, in particular the preferred synthetic resins described above in conjunction with the product according to the invention, preferably a non-ionic resin, these resins are comprised therein in a quantity ranging from approx. 1.8% by weight, preferably approx. 6% by weight, to approx. 26% by weight, preferably to approx. 18% by weight, more preferably in a quantity ranging from approx. 2% by weight, preferably 8% by weight, to approx. 13% by weight, in each case in relation to the overall quantity of the coating composition according to the invention. If a polyester is provided as the synthetic resin, it is comprised therein in a quantity ranging from approx. 5% by weight to approx. 25% by weight, preferably to approx. 10% by weight, in relation to the overall quantity of the coating composition according to the invention. If the binding agent is a polyvinyl acetate, it is comprised therein in a quantity ranging from approx. 1% by weight to approx. 6% by weight in relation to the overall quantity of the coating composition according to the invention.

The coating composition according to the invention can preferably also comprise at least one thickening agent. This is preferably comprised therein in a quantity ranging from approx. 1.5% by weight, preferably approx. 6% by weight, to approx. 30% by weight, preferably approx. 18% by weight, in relation to the overall quantity of the coating composition according to the invention. The at least one thickening agent is particularly preferably an acrylic resin, preferably in an aqueous dispersion, and more preferably anion-active.

The coating composition also preferably comprises water, advantageously, in a quantity ranging from approx. 35% by weight, preferably approx. 40% by weight, more preferably approx. 60% by weight, to approx. 85% by weight, in relation to the overall quantity of the coating composition according to the invention.

The coating composition according to the invention can also comprise urea in such portions as those specified above in conjunction with the coating. The urea remains in its entirety in the coating after drying.

The coating composition according to the invention can also comprise other agents familiar to the person skilled in the art. It can thus be provided, for example, that the coating composition according to the invention comprises defoaming agents, in a quantity preferably ranging from approx. 0.1% by weight to approx. 1% by weight, more preferably approx. 0.15% by weight to approx. 0.5% by weight, in each case in relation to the overall quantity of the coating composition.

The coating composition according to the invention is preferably applied with air knives, or any other suitable method, to the flat carrier material, and subsequently dried. The drying preferably takes place at temperatures ranging from approx. 60° C. to approx. 150° C. The viscosity of the coating composition according to the invention prior to application on the at least one flat carrier material lies in a range of approx. 2,000 mPa to approx. 10,000 mPa, measured at 20° C. in accordance with DIN 53019-1:2008.

The present invention also relates to a method for dyeing or refreshing dyes in textile materials, preferably in a washing machine, wherein the product according to the invention, as described above, is added to textile materials in an aqueous solution at a temperature of at least 20° C., preferably at a temperature ranging from approx. 25° C. to approx. 95° C., more preferably at a temperature ranging from approx. 30° C. to approx. 65° C., over a period of at least 10 minutes, preferably over a period of approx. 15 minutes to approx. 300 minutes, more preferably over a period of approx. 30 minutes to approx. 90 minutes.

The aqueous solution preferably also contains a detergent, in particular a powdered detergent. The pH of the aqueous solution is preferably in a range of approx. 9 to approx. 13. A single laundering with a coloring product according to the invention already leads to a refreshing of the dyeing of the textiles, particularly preferably then when this textile is dark colored, in particular dark blue, dark grey, or black, wherein the coloring product according to the invention is preferably provided with at least one dark blue, dark grey and/or black dye present in the at least one layer thereon.

Lastly, the present invention relates to the use of a coloring product according to the invention for dyeing or refreshing dyes in textile materials made of cotton, organic fibers and/or polyamide. The flat carrier material is preferably a nonwoven, and preferably not made of the aforementioned materials. It is preferably a nonwoven made white or light colored of viscose and/or polyester fibers in particular. The use takes place such that exactly one coloring product according to the invention is added to the mixture of textile materials that is to be dyed or the dyes of which are to be refreshed, preferably in a conventional commercial washing machine.

These and other advantages of the present invention shall be explained in greater detail based on the following exemplary embodiments.

A first coating composition was produced from 83.5% by weight water, 8% by weight of the black dye Sirius Schwarz OB-V01, 8% by weight of the black dye Sirius Schwarz VSF h/c, wherein the two black dyes come from the company Dystar Colours Distribution GmbH, Raunheim, Germany, and 0.5% by weight gum arabic. The percentages relate therein to the overall quantity of the coating composition. Gum arabic is first dissolved in a little water, and then added to the mixture. 6 grams of the aforementioned mixture is applied by means of an air knife to a nonwoven in the form of a flat carrier material, 13.5 cm×19.5 cm, with a weight per unit of surface area of 50 g/m$^2$, and the sheet is subsequently dried at 50° C. As a result, a coating is formed on the flat material, which comprises approx. 2.6% by weight gum arabic and approx. 97.4% by weight dye. A viscose polyester nonwoven is used as the nonwoven, which has a thickness of 0.5 mm. The nonwoven is white. When the product produced in this manner is added to a laundry of black textile materials in a conventional commercial washing machine, while adding a typical amount of conventional commercial powdered detergent, there is practically no greying of the laundered black laundry, even after twenty launderings.

A second coating composition was produced, which comprised 76.3% by weight water, 7.2% by weight of a non-ionic binding agent with a polyester base, 2.5% by weight of a further non-ionic binding agent with a vinyl acetate homopolymer base, 8% by weight Sirius Schwarz OB-V01 and 6% by weight Sirius Schwarz VSF h/c. The percentages are in relation to the overall quantity of the coating composition. This second coating composition has a viscosity of approx. 5,000 mPa at 20° C., in accordance with DIN 53019-1:2008. It is applied with an air knife to a flat carrier material in the form of a nonwoven identical to that used for the first coating composition, which is 13.5 cm×19.5 cm, and subsequently dried at 100° C. The quantity of the dried coating on the nonwoven was approx. 24 g/m$^2$. Approximately 41% by weight of the two binding agents and approx. 59% by weight of the two dyes were present in the coating. Twenty launderings were each carried out with a product, and the weight of the product was recorded thereby prior to and after the laundering. There was a difference of 0.4 g to 0.5 g thereby, meaning that the coating had been released in practically its entirety from the flat carrier material. The obtained flat carrier material in the form of the nonwoven was practically white. Even after 20 launderings, the laundry washed with this product showed no indication of greying.

In accordance with the second coating composition, a third coating composition was produced with 62.3% by weigh water, 7.2% by weight of a first binding agent with a polyester base, 2.5% by weight of a second binding agent with a vinyl acetate homopolymer base, 16% by weight of the black dye Sirius Schwarz OB-V01 and 12% by weight of the black dye Sirius Schwarz VSF h/c. The percentages relate therein to the overall quantity of the coating composition. This third aqueous coating composition was applied with an air knife to a flat material in the form of a nonwoven, as described above in conjunction with the first coating composition, and subsequently dried at 100° C. The viscosity of the third coating composition was approx. 7,000 mPa at 20° C., in accordance with DIN 53019-1:2008. The coating on the finished coloring product comprised up to approx. 26% by weight of the two binding agents and approx. 74% by weight of the two dyes. The quantity of coating on the carrier material was approx. 1 g. The total of twenty launderings specified for the second coating composition were carried out on black laundry with the coloring product obtained through the third coating composition in a conventional commercial washing machine using a typical powdered detergent. The laundering took place, as with the aforementioned cases, at 40° C. in a colored laundry program. The laundry comprised in each case a pair of black jeans and a black T-shirt, as was also the case for the first two coating compositions. The conventional commercial powdered detergent was, by way of example, Ariel® Color from the company Henkel KGaA, of Dusseldorf, Germany. The coloring products with the third coating composition tested in the 20 launderings were again weighed prior to and after the launderings, and it was determined thereby that the nonwoven was approx. 1 gram lighter after laundering, meaning that practically the entire coating was released from the flat carrier material in the form of a nonwoven. The nonwoven was practically white. The black laundry showed no indication of greying.

A fourth coating composition was produced from 71.25% by weight water, 5.19% by weight of a first, non-ionic binding agent and 2.35% by weight of a second non-ionic binding agent, wherein the first binding agent was a polyester, and the second binding agent was a vinyl acetate homopolymer, wherein the coating composition further comprised 6.07% by weight Sirius Schwarz OB-V01, 4.55% by weight Sirius Schwarz VSF h/c, 0.3% by weight of a defoaming agent, 7.5% by weight urea, and 2.79% by weight of a thickening agent with a polyacrylate base that is anion-active and has no color trapping properties, wherein the percentages are in relation in each case to the overall quantity of the coating composition. This coating composition was applied to a flat material in the form of a nonwoven, as described above in conjunction with the first through third coating compositions, and subsequently dried at 100° C. The nonwoven was likewise 13.5 cm×19.5 cm. The coating on the sheet comprised a total of 37.3% by weight of the two dyes and 26.5% by weight of the two binding agents, as well as 26.4% by weight urea and 9.8% by weight of the thickening agent in relation to the overall quantity of coating. The quantity of coating on the carrier material was approx. 1 g. A test was carried out here as well, as described above in conjunction with the third coating composition, in order to determine through laundering how much of the coating was released. It could be established thereby that nearly all of the coating was released. In each case, more than 0.9 g of the coating was always released from the sheet.

A fifth coating composition was produced from 50.58% by weight water, 4.25% by weight of a first, non-ionic binding agent with a polyester base, and 1.94% by weight of a second non-ionic binding agent with a vinyl acetate homopolymer base, wherein the coating composition further comprised 9.73% by weight of a blue reactive dye, specifically Remazol Marine GG, 5.8% by weight urea, 7.4% by weight of a thickening agent with a polyacrylate base that is anion-active and has no color trapping properties, and 0.3% by weight of a defoaming agent, wherein the percentages relate in each case to the overall quantity of the coating composition. 0.544 g of the fifth coating composition was applied to a flat material in the form of a nonwoven that is 13.5 cm×19.5 cm, corresponding to an application of 21 g/m$^2$. The nonwoven weighed 50 g/m$^2$. After drying at 100° C., the coating on the nonwoven contained 13.78% by weight of the first non-ionic binding agent, 6.28% by weight of the second non-ionic binding agent, 31.57% by weight of the blue dye, 24.33% by weight urea and 24.04% by weight of the defoaming agent, wherein the percentages are in relation to the overall quantity of the coating in each case. A test was carried out here, as described above in conjunction with the third coating composition, in order to determine through laundering how much coating is released. It could be established that practically all of the coating was released.

A product for dyeing or refreshing dyes that can be easily used by an end user is created with the coloring product according to the invention and the coating composition according to the invention, as well as the method described above and the use of the product according to the invention. This gives the end user a direct indication of the effects that have been obtained after completing a laundering in the form of a then uncolored product. In accordance with the invention, dark colored, preferably black, pieces of laundry, in particular, are refreshed in terms of their dyeing, or the dyeing thereof is retained, such that a greying is not observed even after numerous launderings of the dark laundry.

The invention claimed is:

1. A coloring product for dyeing or refreshing dyes in textile materials comprising:

a flat carrier material, at least one coating applied to the carrier material, the at one coating including a water soluble binding agent having a dissolution temperature greater than 25° C. and less than 95° C. in an aqueous solution, and at least one dye comprised in the coating, wherein the at least one dye is present in a quantity ranging from 45% by weight to 98% by weight in relation to the overall quantity of the coating, and the flat carrier material is a nonwoven.

2. The product according to claim 1 wherein the at least one binding agent is selected from a group consisting of: organic and/or synthetic resins, gum arabic, guar gum, gelatins, dextrins, agar, alginic acid, alginate, carrageen, albumen, gellan gum, carob gum, pectin, modified cellulose, starches, modified starches, and/or xanthan.

3. The product according to claim 2, wherein the at least one binding agent is selected from the group consisting of synthetic resins comprising polyester, polyvinyl acetate, polyacrylates, polyglycols, polyvinyl alcohol, and/or polyvinylpyrrolidones and mixtures of the specified polymers.

4. The product according to claim 1 wherein the at least one binding agent is present in a quantity ranging from approx. 1% by weight to 50% by weight in relation to the overall quantity of the coating.

5. The product according to claim 1 wherein the coating comprises at least two binding agents, wherein a first binding agent has a pH in a range of approx. 3.5 to approx. 5.5, and a second binding agent has a pH in a range of approx. 5.6 to approx. 9.

6. The product according to claim 1 wherein the at least one binding agent is non-ionic.

7. The product according to claim 1 wherein the at least one dye is an azo dye.

8. The product according to claim 1 wherein the at least one dye is black.

9. The product according to claim 1 wherein the at least one dye has a pH in a range of approx. 7 to approx. 11.

10. The product according to claim 1 wherein there are at least two dyes in the coating.

11. The product according to claim 1 wherein the coating also comprises at least one thickening agent.

12. The product according to claim 1 wherein the flat carrier material is a viscose/polyester nonwoven.

13. The product according to claim 1 wherein the flat carrier material cannot be dyed by the at least one dye.

14. A method for dyeing or refreshing dyes in textile materials, optionally in a washing machine, wherein a product according to claim 1 is added to textile materials in an aqueous solution at a temperature of at least 20° C. over a period of at least 10 minutes.

15. The method according to claim 14, wherein the pH value of the aqueous solution lies in a range of 9 to 13.

* * * * *